United States Patent [19]

Volta et al.

[11] 4,082,334

[45] Apr. 4, 1978

[54] INTERIOR SECURITY DEVICE FOR DOUBLE DOORS

[76] Inventors: Victor S. Volta, 10214 Portal Ave., Cupertino, Calif. 95014; Joe E. Martin, 379 Howard Dr., Santa Clara, Calif. 95051

[21] Appl. No.: 808,723

[22] Filed: Jun. 22, 1977

[51] Int. Cl.[2] ..... E05C 19/18

[52] U.S. Cl. ..... 292/288

[58] Field of Search ..... 292/162, 258, 288, 259

[56] References Cited

U.S. PATENT DOCUMENTS

| | | | |
|---|---|---|---|
| 3,383,130 | 5/1968 | DeAvila | 292/288 X |
| 3,843,178 | 10/1974 | Eskoff | 292/288 X |
| 4,012,065 | 3/1977 | Miller | 292/288 |

*Primary Examiner*—Richard E. Moore
*Attorney, Agent, or Firm*—Jack M. Wiseman

[57] ABSTRACT

A metallic interior security device for double doors comprising a plate of sufficient length to extend beyond adjacent door knobs of the double doors. Formed in the plate are longitudinally spaced slots. The slots are elongated in the longitudinal direction of the plate and are disposed along the plate to receive the neck or narrow portions of the adjacent door knobs, respectively. The width of the elongated slots is greater than the diameter of the neck portions of the door knobs to accommodate the neck portions thereof simultaneously, and is of a lesser diameter than the diameter of the enlarged portions of the door knobs to prevent the removal of the door knobs from locking engagement with the plate.

14 Claims, 5 Drawing Figures

INTERIOR SECURITY DEVICE FOR DOUBLE DOORS

BACKGROUND OF THE INVENTION

The present invention relates in general to interior security devices for doors, and more particularly to an interior security device for double doors.

Heretofore, double doors were secured from the inside of a building by a bar extending across u-shaped brackets fixed to the respective double doors. The patent to Marshall U.S. Pat. No. 694,975, issued on Mar. 11, 1902, for Shutter Holder, discloses a link with longitudinally spaced, transversely extending slots at the ends of the link for placement behind rings of double shutters. It was heretofore known to employ a metal plate with longitudinally spaced, transversely extending slots for placement between the interior portions of double doors and interior knobs fixed to respective adjacent double doors.

In the patent to Cassileth U.S. Pat. No. 2,151,587, issued on Mar. 21, 1939, for Door Handle Lock, there is described a flat, resilient plate member with loops at the ends thereof for placement between adjacent doors of an automobile and the door handles on the respective doors. The patent to Jenks U.S. Pat. No. 2,899,229, issued on Aug. 11, 1959, for Child Proof Cabinet Lock, shows a coil spring with hook ends to encircle door operating hardware.

Other patents of interest are:

U.S. Pat. No. 2,532,586;

U.S. Pat. No. 3,059,952.

The security devices for double doors heretofore known were not adaptable for accommodating variations in distances between the adjacent door knobs. Additionally, merely raising the plate of the security device resulted in the removal of the security device from the locking position.

SUMMARY OF THE INVENTION

An interior security device for adjacent double doors with adjacent interior door knobs comprising a rigid plate with longitudinally spaced and transversely disposed openings to receive interior adjacent door knobs and communicating with said transverse openings, respectively, are longitudinally spaced and longitudinally extending openings for simultaneously locating adjacent door knobs therein. Said longitudinally extending openings having a transverse width greater than the diameter of the neck portion of the door knobs, and a transverse width lesser than the dimension of the enlarged portion of the door knobs.

By virtue of the present invention, various distances between door knobs can be accommodated by a rigid plate security device. Removal of the security device of the present invention from the locking position requires a multi-directional movement. First, the device is moved longitudinally. Then, the device is pivoted for the removal from one knob. This is followed by a lifting of the device in the transverse direction for its removal from the other door knob.

DESCRIPTION OF THE PREFERRED EMBODIMENT

Figure 1:
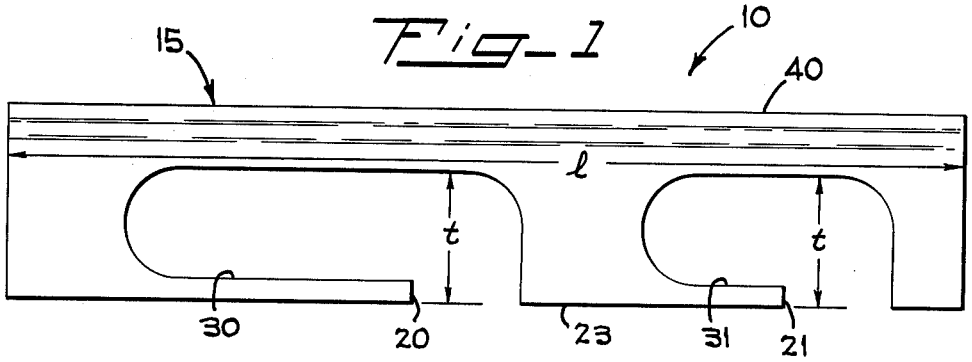
FIG. 1 is a front elevation view of the security device embodying the present invention.

Illustrated in FIG. 1 is a security device 10 embodying the present invention which is made of a rigid plate or bar 15. In the exemplary embodiment, the plate 15 is made of steel, iron or aluminum. Other rigid metals or a rigid plastic material would also be suitable.

Figure 2:
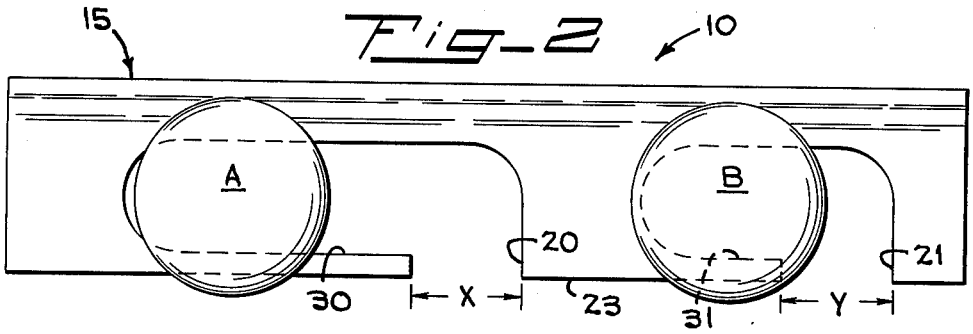
FIG. 2 is a front elevation view of the security device shown in FIG. 1 illustrated installed on the door knobs of double doors in the locking position.
Figure 3:
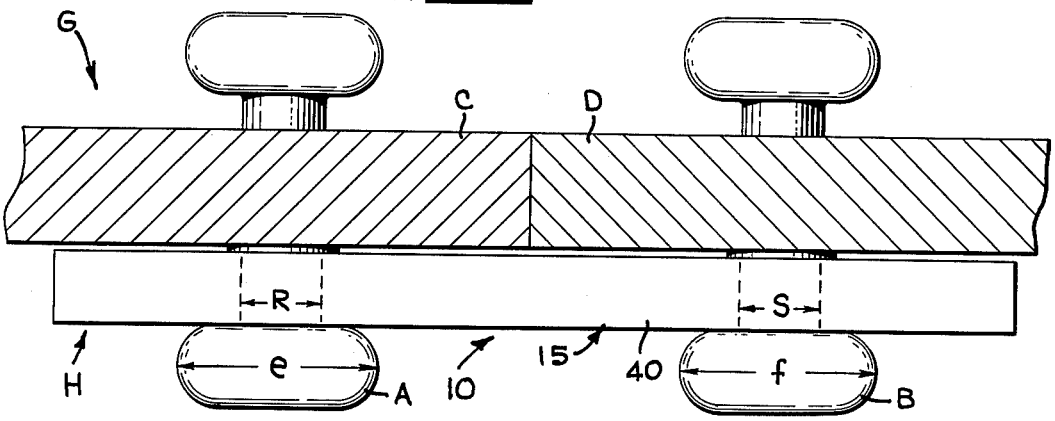
FIG. 3 is a plan view of the security device shown in FIG. 1 shown installed on the door knobs of double doors in the locking position with portions of the double doors shown in section.
Figure 4:
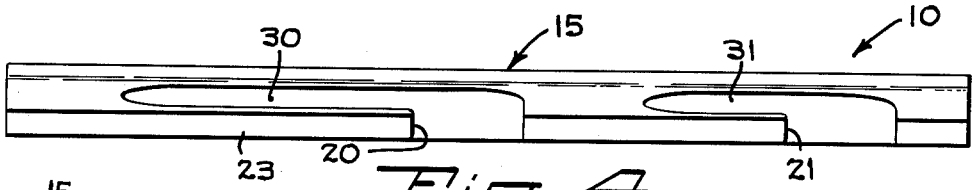
FIG. 4 is a bottom view of the security device shown in FIG. 1.

The plate 15 is greater in longitudinal dimension than the distance between adjacent door knobs and is formed with longitudinally spaced openings 20 and 21 formed along the lower wall 23 of the plate 15. The openings 20 and 21 are of a sufficient dimension to receive the neck or narrow portions of door knobs A and B, which are fixed to double doors C and D, respectively (FIGS. 2 and 3). More specifically, the distance X shown in FIG. 2 is greater than the dimension R of the neck of the door knob A (FIG. 3), and the distance Y is greater than the dimension S of the neck of the door knob B. Thus, the necks of the door knobs A and B pass through the openings 20 and 21. The openings 20 and 21 are formed in the plate 15 to provide transversely disposed slots. The longitudinal direction is shown by the letter "*l*" in FIG. 1 and the transverse direction is shown by the letter "*t*" in FIG. 1.

Communicating with the transverse slots 20 and 21 are longitudinally spaced, longitudinal extending slots 30 and 31, respectively. In the preferred embodiment, the slots 30 and 31 are of different longitudinal dimensions. In this manner, variations in distances between adjacent door knobs, such as the door knobs A and B, can be accommodated by the plate 15. The longitudinally extending slots 30 and 31 are formed in the plate 15 so that the transverse dimension thereof is greater than the necks R and S, respectively, of the door knobs A and B, but lesser than the enlarged portions *e* and *f*, respectively, of the door knobs A and B (FIG. 3).

First, the plate 15 is placed over the door knob A with the opening 20 facing downwardly to receive the neck of the door knob A. The plate 15 is moved downwardly until the neck of the door knob A is fully inserted in the slot 20 to engage the wall of the plate 15 confronting the slot 20. The neck of the door knob A is moved into the longitudinal slot 30 so that the slot 21 can be placed or pivoted over the neck of the door knob B. The plate 15 is pivoted or lowered at the slot 21 until the neck of the door knob B is fully inserted into the slot 21. Now the plate is moved in the longitudinal direction so that the necks of the door knobs A and B are located or received simultaneously in the slots 30 and 31, respectively. At this time, the security device 10 serves to prevent the unauthorized opening of the double doors C and D from the outside of the building, as viewed in the direction G in FIG. 3. The interior of the building is viewed in the direction H in FIG. 3.

In removing the plate 15 from the locking position, the plate 15 is moved longitudinally until the neck of the door knob B is positioned in the slot 21. Then, the plate 15 is pivoted away from the door knob B. Now, the plate 15 is moved longitudinally until the neck of the door knob A is disposed in the slot 20. The plate 15 is lifted until the plate 15 is removed from the door knob A.

Figure 5:
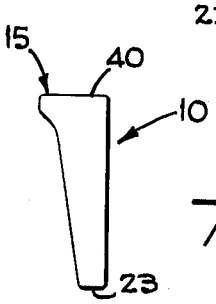
FIG. 5 is an end view of the security device shown in FIG. 1.

The plate 15 is tapered downwardly and inwardly from a top wall 40 to the bottom wall 23 (FIG. 5). This arrangement facilitates the placement of the plate 15 into the locking position and the removal of the plate 15 from the locking position. The wall of the plate 15 facing the double doors is formed with a more gradual taper than is the opposing wall. In addition, the thicker upper portion of the plate 15 serves to reduce the play between the doors C and D should one seek to open the doors C and D without sacrificing the facility in which the plate 15 can be placed on the knobs A and B.

We claim:

1. In combination, a security device and double doors, said double doors having adjacent door knobs, said security device comprising a rigid plate with an upper wall and lower wall and having a longitudinal direction and a transverse direction, longitudinally spaced openings formed in the lower wall of said plate to receive respectively the narrow portions of adjacent door knobs, and longitudinally spaced and longitudinally extending slots formed in said plate intermediate the upper and lower walls thereof communicating respectively with said openings formed in said plate for locating therein simultaneously the narrow portions of said adjacent door knobs, the transverse dimension of said slots being greater than the narrow portions of the respective door knobs, and lesser than the enlarged portions of the respective door knobs to prevent the opening movement of said double doors when the narrow portions of said knobs are respectively received by said slots.

2. A combination as claimed in claim 1 wherein said longitudinally spaced openings are in the form of transversely disposed slots.

3. A combination as claimed in claim 1 wherein said longitudinally extending slots formed in said plate are of different longitudinal dimensions.

4. A combination as claimed in claim 2 wherein said longitudinally extending slots formed in said plate are of different longitudinal dimensions.

5. A combination as claimed in claim 4 wherein said plate is made from metal.

6. A combination as claimed in claim 1 wherein said plate is reduced in thickness in the direction from said upper wall to said lower wall.

7. A combination as claimed in claim 3 wherein said plate is reduced in thickness in the direction from said upper wall to said lower wall.

8. A combination as claimed in claim 4 wherein said plate is reduced in thickness in the direction from said upper wall to said lower wall.

9. A combination as claimed in claim 5 wherein said plate is reduced in thickness in the direction from said upper wall to said lower wall.

10. A security device for double doors with adjacent door knobs comprising a rigid plate with an upper wall and a lower wall and having a longitudinal direction and a transverse direction, longitudinally spaced openings formed in the lower wall of said plate to receive respectively the narrow portions of adjacent door knobs, and longitudinally spaced and longitudinally extending slots formed in said plate intermediate the upper and lower walls thereof communicating respectively with said openings formed in said plate for locating therein simultaneously the narrow portions of adjacent door knobs, said longitudinal extending slots formed in said plate being of different longitudinal dimensions.

11. A security device as claimed in claim 10 wherein said plate is reduced in thickness in the direction from said upper wall to said lower wall.

12. A security device as claimed in claim 10 wherein said longitudinally spaced openings are in the form of transversely disposed slots.

13. A security device for double doors with adjacent door knobs comprising a rigid plate with an upper wall and lower wall and having a longitudinal direction and a transverse direction, longitudinally spaced openings formed in the lower wall of said plate to receive respectively the narrow portions of adjacent door knobs, and longitudinally spaced and longitudinally extending slots formed in said plate intermediate the upper and lower walls thereof communicating respectively with said openings formed in said plate for locating therein simultaneously the narrow portions of adjacent door knobs, said plate being reduced in thickness in the direction from said upper wall to said lower wall.

14. A security device as claimed in claim 13 wherein said longitudinally spaced openings are in the form of transversely disposed slots.

* * * * *